US010042380B1

(12) United States Patent
Hung et al.

(10) Patent No.: US 10,042,380 B1
(45) Date of Patent: Aug. 7, 2018

(54) CURRENT FLATTENING CIRCUIT, CURRENT COMPENSATION CIRCUIT AND ASSOCIATED CONTROL METHOD

(71) Applicant: MACRONIX INTERNATIONAL CO., LTD., Hsinchu (TW)

(72) Inventors: Chun-Hsiung Hung, Hsinchu (TW); Shang-Chi Yang, Changhua County (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 0 days.

(21) Appl. No.: 15/427,234

(22) Filed: Feb. 8, 2017

(51) Int. Cl.
*G05F 3/04* (2006.01)
*G05F 5/00* (2006.01)

(52) U.S. Cl.
CPC ..... *G05F 5/00* (2013.01)

(58) Field of Classification Search
CPC ..... G05F 5/00; G05F 3/02; G05F 3/08
USPC ..... 323/311–317
See application file for complete search history.

(56) References Cited

U.S. PATENT DOCUMENTS 6,570,371 B1 * 5/2003 Volk ..... G05F 3/262 323/315
6,747,508 B2 6/2004 Liu et al.
7,728,655 B2 6/2010 Ng et al.
7,852,054 B2 12/2010 Kao et al.
7,944,194 B2 5/2011 Huang et al.
8,120,415 B2 2/2012 Conte et al.
2007/0076890 A1 * 4/2007 Muresan ..... H04L 9/003 380/287
2009/0167423 A1 * 7/2009 Chiu ..... G05F 1/575 327/543
2015/0227158 A1 * 8/2015 Sako ..... G05F 1/561 323/313
2016/0072516 A1 * 3/2016 Shill ..... H03M 1/06 341/118
2017/0192444 A1 * 7/2017 Usuda ..... G05F 1/575

* cited by examiner

*Primary Examiner* — Alex Torres-Rivera
(74) *Attorney, Agent, or Firm* — McClure, Qualey & Rodack, LLP

(57) ABSTRACT

A current flattening circuit, a current compensation circuit and associated control method are provided. The current flattening circuit is electrically connected to a core node, and includes a reference voltage regulator and the current compensation circuit. The reference voltage regulator generates a reference voltage, wherein the reference voltage is constant. The current compensation circuit is electrically connected to the core node and the reference voltage regulator. The current compensation circuit generates a compensation current according to a potential difference between the reference voltage and a core voltage corresponding to the core node.

17 Claims, 7 Drawing Sheets

CURRENT FLATTENING CIRCUIT, CURRENT COMPENSATION CIRCUIT AND ASSOCIATED CONTROL METHOD

FIELD OF THE DISCLOSURE

The disclosure relates in general to a current flattening circuit, a current compensation circuit and associated control method, and more particularly to a current flattening circuit, a current compensation circuit and associated control method capable of preventing a core circuit from power consumption analysis.

BACKGROUND OF THE DISCLOSURE

Description of the Related Art

Nowadays, semiconductor chips are widely used to implement most electronic devices, and security issue has become an important issue in the design process of embedded systems.

FIG. 1 is a schematic diagram illustrating a current meter being inserted in between a voltage source and a chip to detect operation of a core circuit. The chip 10 has a power pin for receiving a source voltage Vsrc from the voltage source. The chip 10 may include a core circuit 15, and the sequence of instructions being executed by the core circuit 15 can be revealed through current detection result of a current meter 11.

Because the power consumed by the core circuit 15 varies according to activities of the core circuit 15, and a supply current (Ivdd) flowing to the core circuit 15 may contain information about the operations being performed and the data being processed, differential power analysis (hereinafter, DPA) techniques are developed to exploit the correlation between instantaneous power dissipation of the core circuit 15 to analyze operation of the core circuit 15. Therefore, techniques for preventing the operation of a core circuit 15 from being analyzed are demanded.

SUMMARY OF THE DISCLOSURE

The disclosure is directed to a current flattening circuit, a current compensation circuit and associated control method.

According to a first aspect of the present disclosure, a current flattening circuit is provided. The current flattening circuit is electrically connected to a core node. The current flattening circuit includes a reference voltage regulator and a current compensation circuit. The reference voltage regulator generates a reference voltage, wherein the reference voltage is constant. The current compensation circuit is electrically connected to the core node and the reference voltage regulator. The current compensation circuit generates a compensation current according to a potential difference between the reference voltage and a core voltage corresponding to the core node.

According to a second aspect of the present disclosure, a current compensation circuit is provided. The current compensation circuit is electrically connected to a core node, and the current compensation circuit includes a voltage matching circuit and a first current circuit. The voltage matching circuit receives a reference voltage and a core voltage corresponding to the core node. An output signal of the voltage matching circuit changes in response to a potential difference between the reference voltage and the core voltage. The first current circuit is electrically connected to the core node and the voltage matching circuit and generates a compensation current.

According to a third aspect of the present disclosure, a control method applied to a current flattening circuit is provided. The control method includes following steps. Firstly a reference voltage being constant is generated. Then, a compensation current is generated according a potential difference between the reference voltage and a core voltage corresponding to the core node. The compensation current forms a part of the supply current.

The above and other aspects of the disclosure will become better understood with regard to the following detailed description of the preferred but non-limiting embodiment(s). The following description is made with reference to the accompanying drawings.

DETAILED DESCRIPTION OF THE DISCLOSURE

This disclosure proposes a current flattening circuit, a current compensation circuit, and associated control method. With the current compensation circuit, current deviation being measured at the current meter can remain relatively stable.

For the sake convenience, nodes and their voltages can be represented in same symbols in this context. For example, a ground voltage and a ground voltage node are both denoted by "Gnd".

Figure 2:
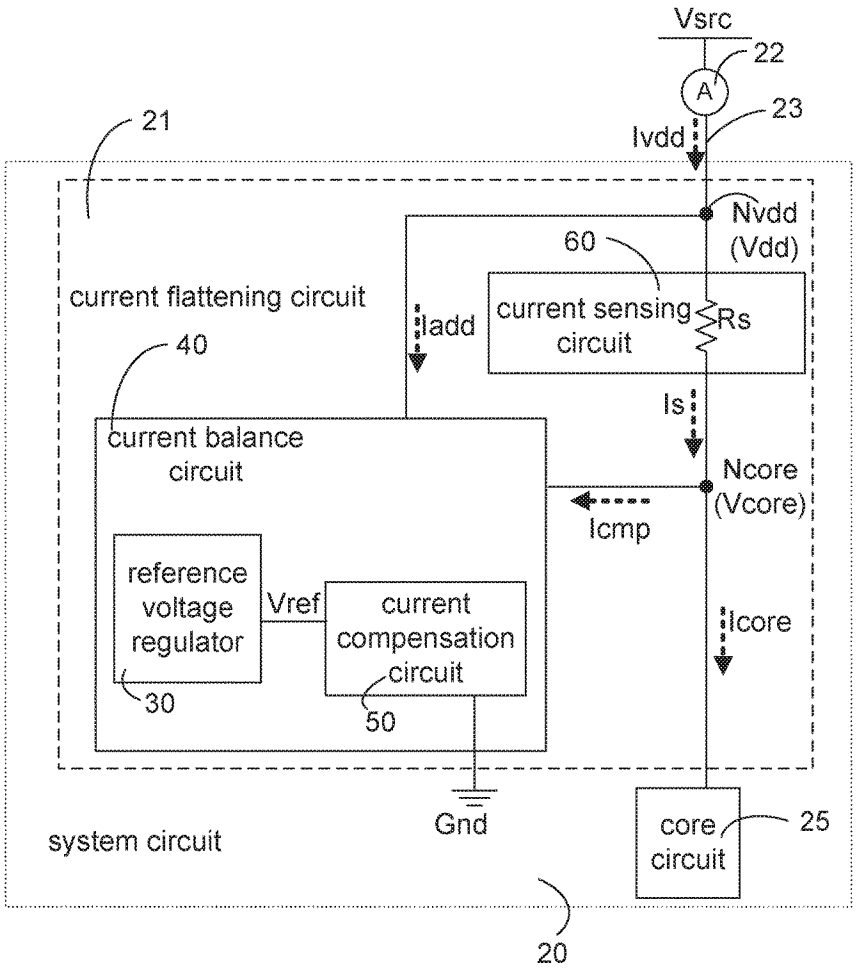
FIG. 2 is a schematic diagram illustrating a system circuit including a current flattening circuit and a core circuit.
Figure 1:
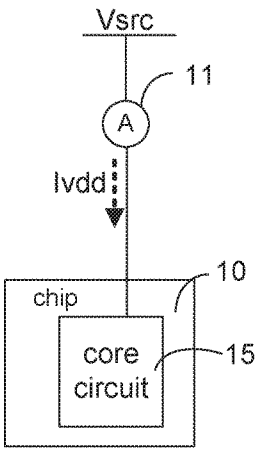
FIG. 1 (prior art)
FIG. 1 (prior art) is a schematic diagram illustrating a current meter being inserted in between a voltage source and a chip to detect operation of a core circuit.

FIG. 2 is a schematic diagram illustrating a system circuit including a current flattening circuit and a core circuit. The system circuit 20 includes a core circuit 25 and a current flattening circuit 21, and a power pin 23 of the system circuit 20 is electrically connected to a voltage source providing a source voltage (Vsrc). Being serially connected to the power pin 23, the current meter 22 measures a supply current (Ivdd) flowing through the power pin 23 in order to acquire operation of the core circuit 25.

The current flattening circuit 21 is electrically connected between the power pin 23 and the core circuit 25. A node where the current flattening circuit 21 is connected to the power pin 23 is defined as a supply voltage node (Nvdd). A node connected to the core circuit 25 and the current flattening circuit 21 is defined as a core node (Ncore), and a voltage level of the core node (Ncore) is defined as a core voltage (Vcore). Furthermore, a core current (Icore) represents a current flowing from the core node (Ncore) to the core circuit 25, and the core current (Icore) varies in response to operation of the core circuit 25. The system circuit 20 may be system-on-chip or system-on-package, and the core current (Icore) usually cannot be detected but the supply current (Ivdd). Therefore, the present disclosure proposes different embodiments to depress the fluctuation of the supply current (Ivdd).

According to an embodiment of the present disclosure, the current flattening circuit 21 includes a current sensing circuit 60 and a current balance circuit 40. The current sensing circuit 60 is electrically connected to the supply voltage node (Nvdd) and the core node (Ncore). The current sensing circuit 60 can be, for example, a sensing resistor Rs, and a current flowing through the current sensing circuit 60 is defined as a sensing current (Is). The current balance circuit 40 is electrically connected to the core node (Ncore).

According to the present disclosure, current value of the sensing current (Is) is preferred to maintain consistent and consistency of the sensing current (Is) can be maintained most of the time. At the core node (Ncore), the sensing current (Is) flowing through the current sensing circuit 60 is split into two portions, the core current (Icore) and the compensation current (Icmp). Therefore, the sensing current (Is) is equivalent to summation of the core current (Icore) and the compensation current (Icmp). Based on such summation relationship, there is a negative correlation between the compensation current (Icmp) and the core current (Icore), and the fluctuation of the sensing current (Is) can be eliminated.

At the supply voltage node (Nvdd), the supply current (Ivdd) flowing through the power pin 23 is split into two portions, the sensing current (Is) and an additional current (Iadd). The additional current (Iadd) is selectively generated. When the additional current (Iadd) is generated, the supply current (Ivdd) is equivalent to summation of the sensing current (Is) and the additional current (Iadd). Otherwise, the supply current (Ivdd) is equivalent to the sensing current (Is). In general, the additional current (Iadd) is relatively smaller than the sensing current (Is).

The current balance circuit 40 further includes a reference voltage regulator 30 and a current compensation circuit 50, which are electrically connected to each other. The reference voltage regulator 30 provides a reference voltage (Vref) to the current compensation circuit 50, and the voltage level of the reference voltage (Vref) is designed to be constant.

Theoretically speaking, the core voltage (Vcore) should be maintained to be equivalent to multiple of the reference voltage (Vref). For the sake of illustration, the core voltage (Vcore) is assumed to be equivalent to the reference voltage (Vref). The current balance circuit 40 dynamically adjusts generation of the compensation current (Icmp) and the additional current (Iadd) based on the core voltage (Vcore) and the reference voltage (Vref). Whenever a potential difference between the reference voltage (Vref) and the core voltage (Vcore) occurs, current value of the compensation current (Icmp) will change to minimize the potential difference.

When the core current (Icore) increases, the sensing current (Is) increases, the voltage drop across the sensing resistor (Rs) increases and in turn the core voltage (Vcore) is decreased. In such case, the reference voltage (Vref) becomes greater than the core voltage (Vcore), and the potential difference between the reference voltage (Vref) and the core voltage (Vcore) results in change of the compensation current (Icmp). That is, the compensation current (Icmp) starts to decrease. Accompanied with the decrease of the compensation current (Icmp), the core voltage (Vcore) will increase. Then, the core voltage (Vcore) continues to increase until the core voltage (Vcore) is equivalent to the reference voltage (Vref). Accordingly, the core voltage (Vcore) can be maintained to be close to the reference voltage (Vref).

As a result, the voltage drop across the sensing resistor Rs, that is, (Vdd-Vcore), can be consistent because the core voltage (Vcore) is maintained to be equivalent to the reference voltage (Vref). According to Ohm's low, the sensing current (Is) through the sensing resistor (Rs) can be obtained by (Vdd-Vcore)/Rs. Due to the consistency of the supply voltage (Vdd), the core voltage (Vcore) and the resistance of the sensing resistor (Rs), fluctuation of the sensing current (Is) is minimized.

Figure 3:
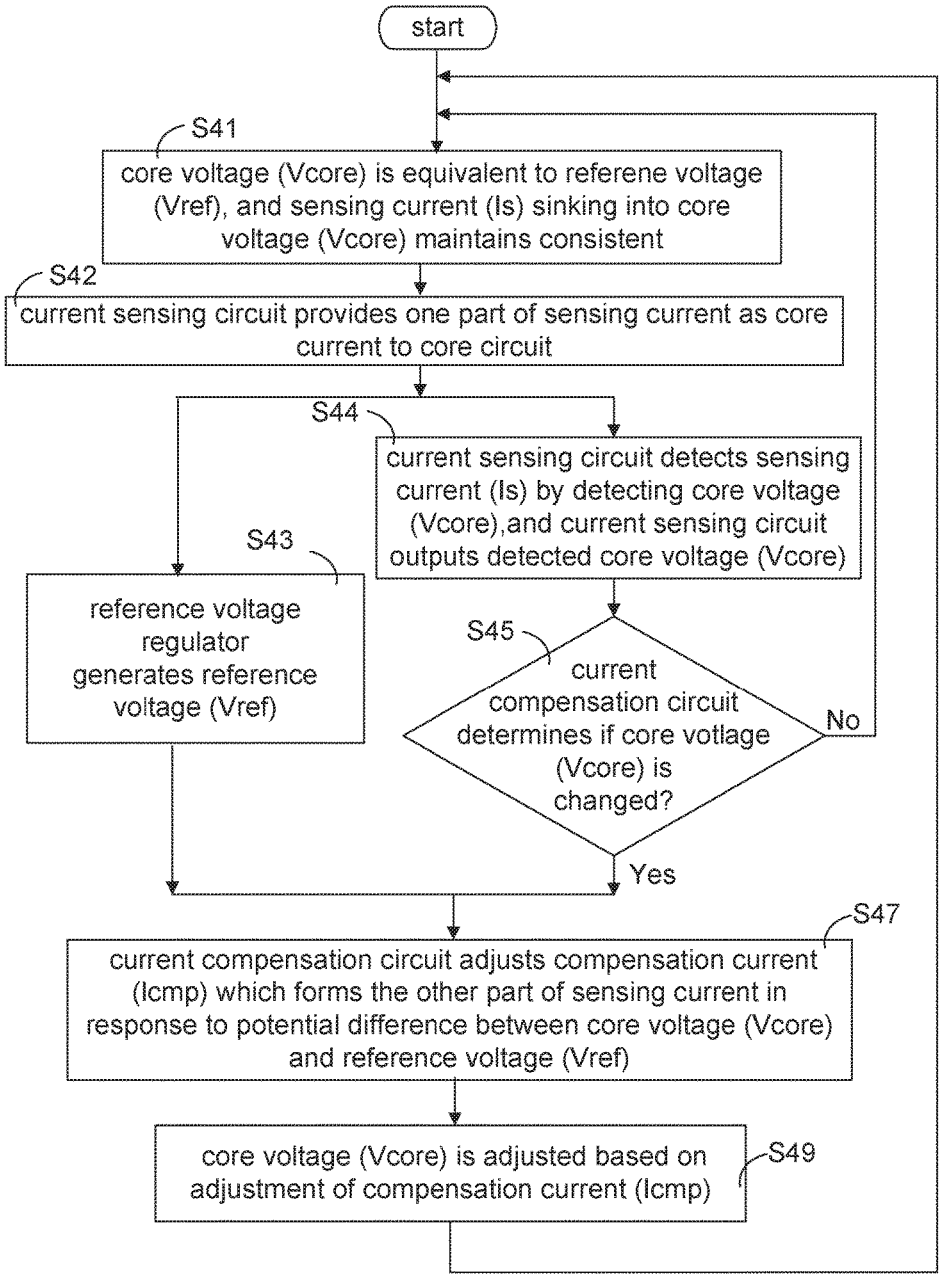
FIG. 3 is a flow chart illustrating how operation of the current flattening circuit maintains consistency of the core voltage.

FIG. 3 is a flow chart illustrating how operation of the current flattening circuit 21 maintains consistency of the core voltage. At the beginning, the current flattening circuit 21 and the core circuit 25 are assumed to be at a balance state. When the current flattening circuit 21 and the core circuit 25 are at the balance state, the core voltage (Vcore) is equivalent to the reference voltage (Vref), and the sensing current (Is) sinking into the core voltage (Vcore) maintains consistent (step S41). The current sensing circuit 60 provides part of the sensing current (Is) as the core current (Icore) to the core circuit 25 (step S42).

The reference voltage regulator 30 continuously generates the reference voltage (Vref) (step S43). Meanwhile, the current sensing circuit 60 detects the sensing current (Is) by detecting the core voltage (Vocre), and the current sensing circuit 60 outputs the detected core voltage (Vcore) to the current compensation circuit 50 (step S44). After receiving the core voltage (Vcore) from the current sensing circuit 60, the current compensation circuit 50 determines if the core voltage (Vcore) is changed (step S45). If the determination result of step S45 is negative, step S41 is repeatedly executed.

If the determination result of step S45 is positive, the current compensation circuit 50 adjusts the compensation current (Icmp) which forms the other part of the sensing current (Is) in response to potential difference between the core voltage (Vcore) and the reference voltage (Vref) (step S47). Then, the core voltage (Vcore) is adjusted based on the adjustment of the compensation current (Icmp) (step S49). Then, the whole operation flow is recursively executed.

As illustrated above, the sensing current (Is) can be separated into two parts, the core current (Icore) and the compensation current (Icmp). When the core current (Icore) changes in response to operation of the core circuit 25, the compensation current (Icmp) is adjusted in an inverse manner.

Various embodiments of the reference voltage regulator and the current compensation circuit are respectively illustrated below. These reference voltage regulators and the current compensation circuits can be freely selected and used together.

Figure 4:
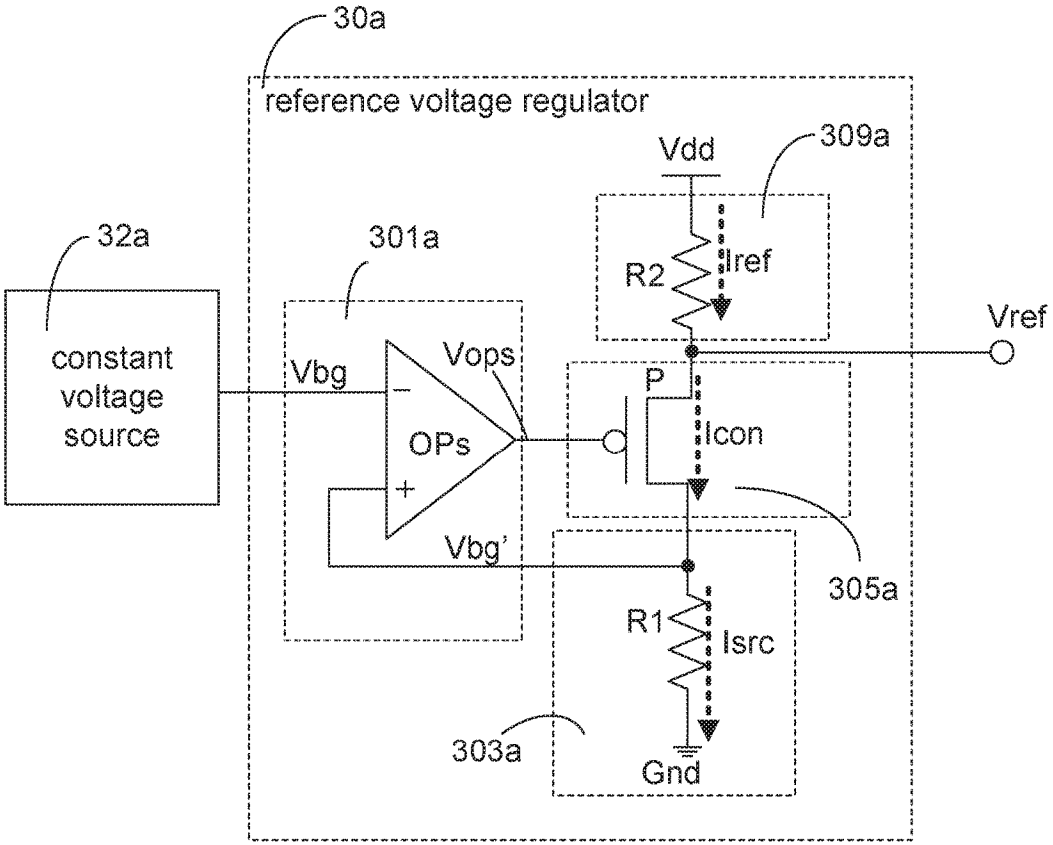
FIG. 4 is a schematic diagram illustrating an embodiment of the reference voltage regulator.

FIG. 4 is a schematic diagram illustrating an embodiment of the reference voltage regulator. The reference voltage regulator 30*a* receives the constant voltage (Vbg) from a constant voltage source 32*a* and generates the reference voltage (Vref) to a reference voltage node. The constant voltage source 32*a* can be, but is not limited to, a bandgap voltage circuit generating a bandgap voltage with minor temperature coefficient. In FIG. 4, the reference voltage regulator 30*a* includes a voltage providing circuit 301*a*, a voltage to current circuit 303*a*, a current conduction circuit 305*a* and a current to voltage circuit 309*a*.

The voltage providing circuit 301*a* includes a source operational amplifier (OPs). An inverting input terminal (−) of the source operational amplifier (OPs) receives the constant voltage (Vbg) from the constant voltage source 32*a*. A non-inverting input terminal (+) of the source operational amplifier (OPs) is electrically connected to the voltage to current circuit 303*a*. A voltage level of the non-inverting input terminal (+) and the inverting input terminal (−) are equivalent, and the non-inverting input terminal (+) of the source operational amplifier (OPs) transmits a pseudo constant voltage (Vbg') to the voltage to current circuit 303*a*. An output terminal of the source operational amplifier (OPs) is electrically connected to the current conduction circuit 305*a*. An output signal (Vops) of the source operational amplifier (OPs) is generated by amplifying potential difference between the constant voltage (Vbg) and the pseudo constant voltage (Vbg'). Basically, the constant voltage (Vbg) and the pseudo constant voltage (Vbg') are equivalent (Vbg=Vbg').

The voltage to current circuit 303*a* includes a first resistor (R1), and the voltage to current circuit 303*a* is electrically connected to the voltage providing circuit 301 and the ground node (Gnd). As represented by equation (1), a source current (Isrc) can be determined by the constant voltage (Vbg) and the first resistor (R1).

$$Isrc=Vbg'/R1=Vbg/R1 \quad \text{equation (1)}$$

The current conduction circuit 305*a* in FIG. 4 includes a PMOS transistor (P). A gate terminal of the PMOS transistor (P) is electrically connected to the output terminal of the voltage providing circuit 301*a*. A source terminal of the PMOS transistor (P) is electrically connected to the current to voltage circuit 309*a*. A drain terminal of the PMOS transistor (P) is electrically connected to the voltage to current circuit 303*a*.

The current to voltage circuit 309*a* includes a second resistor (R2). As shown in FIG. 4, the second resistor (R2) is electrically connected to the supply voltage node (Vdd), and a reference current (Iref) flows through the second resistor (R2). Based on the reference current (Iref), a voltage drop $\Delta V\ R_2$ across the second resistor R2 can be represented by equation (2).

$$\Delta V_{R2=I}\text{ref}*R2=Vdd-V\text{ref} \quad \text{equation (2)}$$

The PMOS transistor (P) is controlled by the output signal (Vops) of the source operational amplifier (OPs). When the PMOS transistor (P) is turned on, a conducted current (Icon) flows through the PMOS transistor (P). As shown in FIG. 4, the conducted current (Icon), the reference current (Iref), and the source current (Isrc) jointly construct the same current path. Therefore, current value of the conducted current (Icon), the source current (Isrc) and the reference current (Iref) are all equivalent to each other, that is, Icon=Isrc=Iref.

Based on the equivalence between the source current (Isrc) and the reference current (Iref), the reference current (Iref) in equation (2) can be replaced by the source current (Isrc). Furthermore, equation (2) can be conducted as equation (3).

$$V\text{ref}=Vdd-I\text{ref}*R2=Vdd-Isrc*R2$$

$$=Vdd-(Vbg*R2)/R1 \quad \text{equation (3)}$$

According to equation (3), the reference voltage (Vref) can be obtained by the supply voltage (Vdd), the constant voltage (Vbg), the voltage to current circuit 303*a* (the first resistor R1), and the current to voltage circuit 309*a* (the second resistor R2), whose values are all determined by the time when the reference voltage regulator 30*a* is designed and manufactured.

Figure 5:
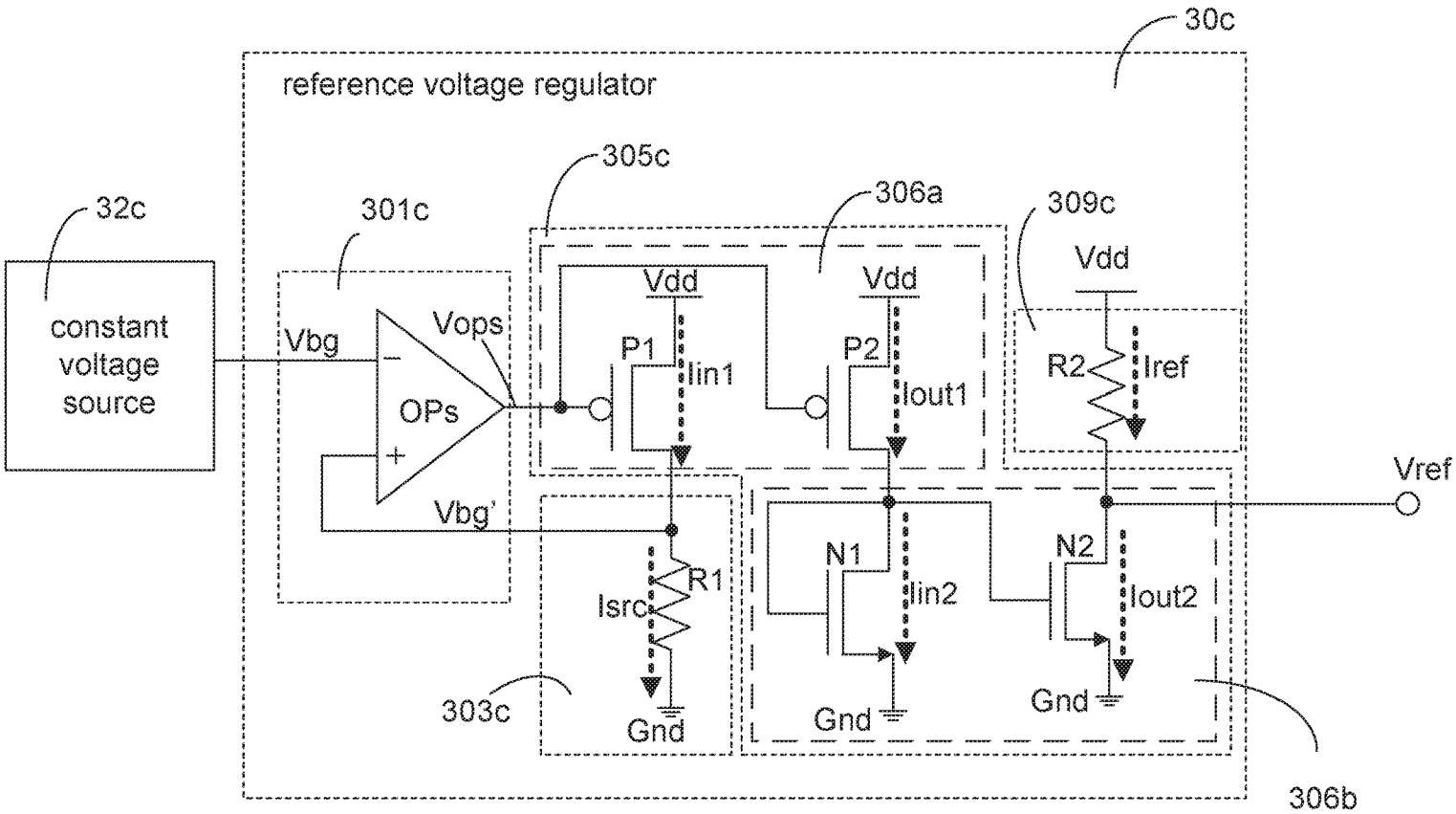
FIG. 5 is a schematic diagram illustrating another embodiment of the reference voltage regulator.

FIG. 5 is a schematic diagram illustrating another embodiment of the reference voltage regulator. The reference voltage regulator 30*c* receives the constant voltage (Vbg) from a constant voltage source 32*c* and generates the reference voltage (Vref) to the current compensation circuit (not shown). In FIG. 5, the reference voltage regulator 30*c* includes a voltage providing circuit 301*c*, a voltage to current circuit 303*c*, a current conduction circuit 305*c*, and a current to voltage circuit 309*c*. The current conduction circuit 305*c* further includes a first current mirror 306*a* and a second current mirror 306*b*.

Connections and operations of the voltage providing circuit 301*c* and the voltage to current circuit 303*c* are similar to those shown in FIG. 4, and details are not redundantly described. Therefore, equation (1) can be applied to the source current (Isrc) in FIG. 5.

The first current mirror 306*a* includes a first PMOS transistor (P1) and a second PMOS transistor (P2). A gate terminal of the first PMOS transistor (P1) and the second PMOS transistor (P2) are electrically connected to the output terminal of the voltage providing circuit 301*c*. A source terminal of the first PMOS transistor (P1) and the second PMOS transistor (P2) are electrically connected to the supply voltage node (Vdd). A drain terminal of the first PMOS transistor (P1) is electrically connected to the voltage to current circuit 303*c*, and a drain terminal of the second PMOS transistor (P2) is electrically connected to the second current mirror 306*b*.

As shown in FIG. 5, the first PMOS transistor (P1) and the first resistor (R1) jointly construct a first current path in which the first mirror input current (Iin1) and the source current (Isrc) flow through. Therefore, current value of the first mirror input current (Iin1) and the source current (Isrc) are equivalent. The first mirror input current (Iin1) flows through the first PMOS transistor (P1), and the first mirror output current (Iout1) flows through the second PMOS transistor (P2). Based on the current mirror structure, the first mirror input current (Iin1) and the first mirror output current (Iout1) are equivalent.

The second current mirror 306*b* includes a first NMOS transistor (N1) and a second NMOS transistor (N2). A gate terminal of the first NMOS transistor (N1) and the second NMOS transistor (N2) are electrically connected to the output terminal of the first current mirror 306*a*. A source terminal of the first NMOS transistor (N1) and the second NMOS transistor (N2) are electrically connected to the ground node (Gnd). A drain terminal of the first NMOS transistor (N1) is electrically connected to the output terminal of the first current mirror 306*a*, and a drain terminal of the second NMOS transistor (N2) is electrically connected to the current to voltage circuit 309*c*.

As shown in FIG. 5, the second PMOS transistor (P2) and the first NMOS transistor (N1) jointly construct a second current path in which the first mirror output (Iout1) and the second mirror input current (Iin2) flow through. Therefore, current value of the first mirror output (Iout1) and the second mirror input current (Iin2) are equivalent. The second mirror input current (Iin2) flows through the first NMOS transistor (N1), and the second mirror output current (Iout2) flows through the second NMOS transistor (N2). Based on the current mirror structure, the second mirror input current (Iin2) and the second mirror output current (Iout2) are equivalent.

The current to voltage circuit 309*c* includes a second resistor (R2). The current to voltage circuit 309*a* in FIG. 4 and the current to voltage circuit 309*c* in FIG. 5 are both connected in between the supply voltage node (Vdd) and the current compensation circuit, and these current to voltage circuits 309*a* and 309*c* operate in a similar manner. Based on the analogies of the connection and position of the second resistor (R2) in FIGS. 4 and 5, a voltage drop across the second resistor $\Delta V_{R2}$ according to equation (2) can also be applied to the second resistor (R2) in FIG. 5.

As shown in FIG. 5, the second resistor (R2) and the second NMOS transistor (N2) jointly construct a third current path in which the reference current Iref and the second mirror output current (Iout2) are equivalent. Based on the above illustrations, the source current (Isrc), the first mirror input current (Iin1), the first mirror output current (Iout1), the second mirror input current (Iin2), the second mirror output current (Iout2), and the reference current (Iref) are assumed to be all equivalent. That is, Isrc=Iin1=Iout=Iin2=Iout2=Iref.

Nonetheless, relationship of the reference voltage (Vref) and the constant voltage (Vbg) can be freely defined so that current transfer ratios between the source current (Isrc), the first mirror input current (Iin1), the first mirror output current (Iout1), the second mirror input current (Iin2), the second mirror output current (Iout2), and the reference current (Iref) may not be equivalent to "1".

Therefore, design of the first current mirror 306*a* and the second current mirror 306*b* are flexible, and current transfer ratios between their input currents (Iin1 and Iin2) and their output currents (Iout1 and Iout2) are not necessary to be equivalent to "1". In consequence, the first mirror input current (Iin1), the first mirror output current (Iout1), the second mirror input current (Iin2), the second mirror output current (Iout2), and the reference current (Iref) can be multiples of the source current (Isrc). Alternatively, a current value of the reference current (Iref) can be proportional to a current value of the source current (Isrc). The design change on the current transfer ratios should be known directly and unambiguously to a person skilled in the art, and will not be described further hereinafter.

Based on the equivalence between the source current (Isrc) and the reference current (Iref), equation (3) can be applied to the reference voltage (Vref) in FIG. 5. Accordingly, the reference voltage (Vref) being provided by the reference voltage regulator 30*c* can remain constant because the supply voltage (Vdd), the constant voltage (Vbg), the voltage to current circuit 303*c* (the first resistor R1), and the current to voltage circuit 309*a* (the second resistor R2) are all determined by the time when the reference voltage regulator 30*c* is designed and manufactured.

According to the embodiments illustrated above, the current conduction circuit 305*a*, 305*c* in the reference voltage regulator 30*a*, 30*c* is capable of bridging the voltage to current circuit 303*a*, 303*c* and the current to voltage circuit 309*a*, 309*c*. The current conduction circuit 305*a*, 305*c* passes a predefined current value of the source current (Isrc) to the current to voltage circuit 309*a*, 309*c* so that the current to voltage circuit 309*a*, 309*c* can utilize the predefined current value as the reference current (Iref).

Alternatively speaking, design of the voltage to current circuit 303*a*, 303*c* dominates the current value of the source current (Isrc). The current value of the source current (Isrc) is provided to the current conduction circuit 305*a*, 305*c*, and a current value of the conducted current (Icon) is determined accordingly. With the bridging function of the current conduction circuit 305*a*, 305*c*, the source current (Isrc) and the reference current (Iref) are always equivalent, and the current values of these currents can be consistently maintained at a predefined value. Consequentially, the current to voltage circuit 309*c* can continuously provide a voltage having a constant value, that is, the reference voltage (Vref), to the current compensation circuit.

As shown in FIGS. 4 and 5, both the current to voltage circuits 309*a* and 309*c* are placed in between the supply voltage node (Vdd) and the reference voltage node having the reference voltage (Vref) to improve power supply rejection ratio (hereinafter, PSRR) of the reference voltage regulators 30*a* and 30*c*.

In a case that disturbance occurs at the supply voltage (Vdd), the reference current (Iref) can basically remain stable because the reference current (Iref) is equivalent to the source current (Isrc), that is, Iref=Is=Vbg/R1. In consequence, the reference voltage (Vref) may change in response to variation of the supply voltage (Vdd). When the reference voltage (Vref) and the supply voltage (Vdd) change simultaneously, the core voltage (Vcore) being determined by the reference voltage (Vref) is also changed with variation of the supply voltage (Vdd). Based on the design that the second resistor (R2) is connected in between the supply voltage node (Vdd) and the reference voltage node (Vref), the source current (Isrc) becomes more resistant to the disturbance of the supply voltage (Vdd).

According to the embodiments of the present disclosure, the reference voltage regulator 30 continuously receives the constant voltage (Vbg) and accordingly provides the reference voltage (Vref) to the current compensation circuit 50. The current compensation circuit 50 then utilizes the reference voltage (Vref) as a comparison base of the core voltage (Vcore). Based on the comparison between the reference voltage (Vref) and the core voltage (Vcore), the current compensation circuit 50 dynamically adjusts generation of the compensation current (Icmp). The following describes the operation of the current compensation circuit 50.

Figure 6:
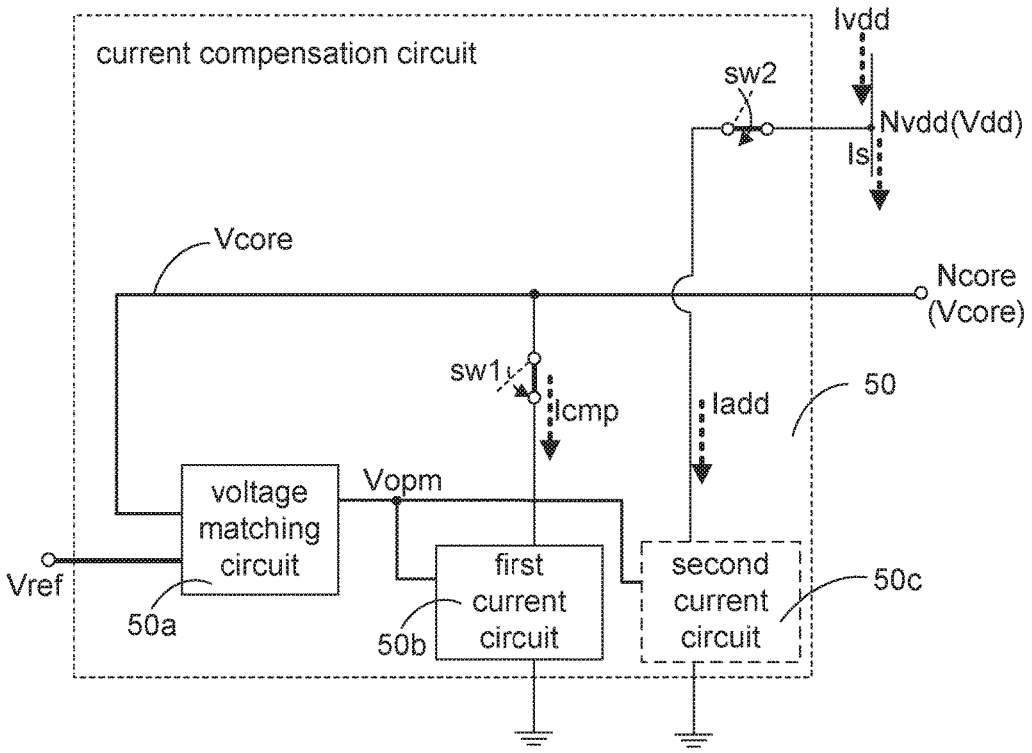
FIG. 6 is a schematic diagram illustrating internal blocks of the current compensation circuit.

FIG. 6 is a schematic diagram illustrating internal blocks of the current compensation circuit. The current compensation circuit 50 includes a voltage matching circuit 50*a* and a first current circuit 50*b*. In addition, the current compensation circuit 50 may further include a second current circuit 50*c*. The first current circuit 50*b* and the second current circuit 50*c* are switchable through a first switch (sw1) and a second switch (sw2), respectively.

The voltage matching circuit 50*a* is electrically connected to the core node (Ncore), and the first current circuit 50*b* is electrically connected to the core node (Ncore) through conduction of the first switch (sw1). The second current circuit 50*c* is electrically connected to the supply voltage node (Nvdd) through conduction of the second switch (sw2). Instead of conducting a current from the core node (Ncore) to the ground node (Gnd) like the first current circuit 50*b* does, the voltage matching circuit 50*a* senses the core voltage (Vcore) only. That is, no current is conducted from the core node (Ncore) to the voltage matching circuit 50*a*.

The first and the second switches (sw1 and sw2) can be selectively turned on or off by the core circuit (not shown), and the first and the second switches (sw1 and sw2) may be implemented by MOS transistors. In practical application, control signals for controlling switching statuses of the first and the second switches (sw1 and sw2) are independent, and these two switches (sw1 and sw2) can be both turned on or only one of which is turned on. Both the control signals can be a random sequence control signal or a continuous high-level control signal turning on the corresponding switch. For the sake of illustration, these two switches are assumed to be both turned on in the context.

The voltage matching circuit 50*a* receives the reference voltage (Vref) from the reference voltage regulator 30, and receives the core voltage (Vcore) from the core node (Ncore). Being used to control the first current circuit 50*b* and the second current circuit 50*c*, an output signal of the voltage matching circuit 50*a* (Vopm) is generated based on a potential difference between the reference voltage (Vref) and the core voltage (Vcore). In the context, the signals being acquired by the voltage matching circuit 50*a* respectively from the reference voltage regulator 30 and the core node (Ncore) are represented in voltages, that is, the reference voltage (Vref) and the core voltage (Vcore). In practical application, the signals being supplied by the reference voltage regulator 30 and the core node (Ncore) can also be represented in currents.

According to the output signal of the voltage matching circuit 50*a* (Vopm), the first current circuit 50*b* and the second current circuit 50*c* respectively generate a compensation current (Icmp) and an additional current (Iadd). The additional current (Iadd) is proportional to the compensation current (Icmp). The compensation current (Icmp) and the additional current (Iadd) are designed to increase when the core current (Icore) decreases, and vice versa.

The supply current (Ivdd) is split into the additional current (Iadd) and the sensing current (Is) at the supply voltage node (Nvdd), and the sensing current (Is) is further split into the compensation current (Icmp) and the core current (Icore) at the core node (Ncore). According to the embodiment of the present disclosure, the sensing current (Is) is greater than the additional current (Iadd) and the sensing current (Is) is the major portion of the supply current (Ivdd).

The relationships between changes of the currents defined in FIGS. 2 and 6 at two different time points (first time point t1 and second time point t2) are listed in the following Table 1.

TABLE 1

| | first time point t1 | second time point t2 | change of current |
|---|---|---|---|
| Icore | Icore(t1) | Icore(t2) | ΔIcore = Icore(t2) − Icore(t1) |
| Icmp | Icmp(t1) | Icmp(t2) | ΔIcmp = Icmp(t2) − Icmp(t1) |
| Is = Icore + Icmp | Is(t1) = Icore(t1) + Icmp(t1) | Is(t2) = Icore(t2) + Icmp(t2) | ΔIs = Is(t2) − Is(t1 ) |
| Iadd | Iadd(t1) | Iadd(t2) | ΔIadd = Iadd(t2) − Iadd(t1) |
| Ivdd = Is + Iadd | Ivdd(t1) = Is(t1) + Iadd(t1 ) | Ivdd(t2) = Is(t2) + Iadd(t2) | ΔIvdd = Ivdd(t2) − Ivdd(t1) |

The first row of Table 1 indicates change of the core current (Icore). The core current at the first time point (t1) and the second time point (t2) are respectively represented as Icore(t1) and Icore(t2). Change of the core current between these two time points (ΔIcore) can be obtained by difference of the core current (Icore) at the first time point (t1) and the second time point (t2), that is, ΔIcore=Icore(t2)−Icore(t1).

The second row of Table 1 indicates change of the compensation current (Icmp). The compensation current at the first time point (t1) and the second time point (t2) are respectively represented as Icmp(t1) and Icmp(t2). Change of the compensation current between these two time points (ΔIcmp) can be obtained by the compensation current (Icmp) at the first time point (t1) and the second time point (t2), that is, ΔIcmp=Icmp(t2)−Icmp(t1).

The third row of Table 1 indicates change of the sensing current (Is). The sensing current at the first time point (t1) and the second time point (t2) are respectively represented as Is(t1) and Is(t2). Change of the sensing current between these two time points (ΔIs) can be obtained by the sensing current (Is) at the first time point (t1) and the second time point Is(t2), that is, ΔIs=Is(t2)−Is(t1).

As illustrated above, the sensing current (Is) is equivalent to summation of the core current (Icore) and the compensation current (Icmp), that is, Is=Icore+Icmp. Therefore, the equation ΔIs=Is(t2)−Is(t1) can be rewritten as equation (4).

$$\begin{aligned}\Delta Is &= Is(t2) - Is(t1)\\ &= [I\text{core}(t2) + Icmp(t2)] - [I\text{core}(t1) + Icmp(t1)]\\ &= [I\text{core}(t2) - I\text{core}(t1)] + [Icmp(t2) + Icmp(t1)]\\ &= \Delta I\text{core} + \Delta Icmp \qquad \text{equation (4)}\end{aligned}$$

Ideally, summation result of equation (4) should be always equivalent to "0". In practical applications, summation result of equation (4) is not equivalent to "0" for some extreme conditions, and the summation result of equation (4) might be a positive value or a negative value. These extreme conditions may occur when the core current (Icore) increases or decreases dramatically in an instantaneous duration.

When the core current (Icore) increases dramatically in the instantaneous duration, decrement speed of the compensation current (Icmp) is slower than the increment speed of the core current (Icore). Therefore, the summation result of equation (4) is positive and this implies that the sensing current (Is) may increase when the core current (Icore) increases dramatically in the instantaneous duration.

When the core current (Icore) decreases dramatically in an instantaneous duration, increment speed of the compensation current (Icmp) is slower than the decrement speed of the core current (Icore). Therefore, the summation result of equation (4) is negative and this implies the sensing current (Is) may decrease when the core current (Icore) decreases dramatically in the instantaneous duration.

Alternatively speaking, in the extreme conditions, variation of the sensing current (Is) can be possibly positively related to variation of the core current (Icore). To further eliminate the relevance of the sensing current (Is) and the core current (Icore) in the extreme conditions, the second current circuit 50*c* is designed to provide the additional current (Iadd) when the second switch (sw2) is turned on. Generation of the additional current (Iadd) is adjustable and the additional current (Iadd) is less than the compensation current (Icmp).

The fourth row of Table 1 indicates change of the additional current (Iadd). The additional current at the first time point (t1) and the second time point (t2) are respectively represented as Iadd(t1) and Iadd(t2). Change of the additional current between these two time points (ΔIadd) can be obtained by the additional current (Iadd) at the first time point (t1) and the second time point (t2), that is, ΔIadd=Iadd(t2)−Iadd(t1). According to the embodiment of the present disclosure, change of the additional current between these two time points (ΔIadd) is less than change of the compensation current between these two points (ΔIcmp), that is, ΔIadd<ΔIcmp.

The fifth row of Table 1 indicates change of the supply current (Ivdd). The supply current (Ivdd) at the first time point (t1) and the second time point (t2) are respectively represented as Ivdd(t1) and Ivdd(t2). Change of the supply current between these two time points (ΔIvdd) can be obtained by the supply current (Ivdd) at the first time point (t1) and the second time point Ivdd(t2), that is, ΔIvdd=Ivdd (t2)−Ivdd(t1). Because the supply current (Ivdd) is equivalent to summation of the sensing current (Is) and the additional current (Iadd), that is, Ivdd=Is+Iadd, the equation ΔIvdd=Ivdd(t2)−Ivdd(t1) can be rewritten as equation (5).

$$\begin{aligned}\Delta Ivdd &= Ivdd(t2)-Ivdd(t1)\\ &=[Is(t2)+Iadd(t2)]-[Is(t1)+Iadd(t1)]\\ &=[Is(t2)-Is(t1)]+[Iadd(t2)-Iadd(t1)]\\ &=\Delta Is+\Delta Iadd \qquad \text{equation (5)}\end{aligned}$$

Based on equation (5), change of the supply current (Ivdd) flowing through the power pin 23 (ΔIvdd) is related to change of the sensing current (ΔIs) and change of the additional current (ΔIadd). Based on equation (4), equation (5) can be rewritten as equation (6).

$$\Delta Ivdd=\Delta Is+\Delta Iadd=(\Delta \mathrm{Icore}+\Delta Icmp)+\Delta Iadd \qquad \text{equation (6)}$$

According to equation (6), change of the supply current (ΔIvdd) includes three portions, change of the core current (ΔIcore), change of the compensation current (ΔIcmp), and change of the additional current (ΔIadd). Based on equation (6), when change of the core current (ΔIcore) occurs, change of the compensation current (ΔIcmp) and the additional current (ΔIadd) can be adjusted to minimize change of the supply current (ΔIvdd), that is, ΔIvdd÷0. Because the compensation current (Icmp) and the additional current (Iadd) have negative correlations with the core current (Icore), fluctuation of the supply current (Ivdd) can be depressed.

In short, the first current circuit 50*b* generating the compensation current (Icmp) can be considered as providing a first stage fluctuation depressing function, and the second current circuit 50*c* generating the additional current (Iadd) can be considered as providing a second stage fluctuation depressing function. Moreover, the first and the second switches (sw1 and sw2) can be selectively switched on with independent control signals so that the supply current (Ivdd) being measured by the current meter 22 becomes more unpredictable.

When the first switch (sw1) is turned on and the first current circuit 50*b* generates the compensation current (Icmp), the sensing current (Is) including the core current (Icore) and the compensation current (Icmp) can be obtained. When the second switch (sw2) is turned on and the second current circuit 50*c* generates the additional current (Iadd), the supply current (Ivdd) including the sensing current (Is) and the additional current (Iadd) can be obtained.

Among these currents, the sensing current (Is) is more consistent than the core current (Icore), and the supply current (Ivdd) is mainly based on the sensing current (Is) and with slight adjustment of the additional current (Iadd). Relative to the sensing current (Is), the fluctuation of the supply current (Ivdd) during transient response would be alleviated because of the additional current (Idd). As shown in FIG. 2, the current meter 22 does not measure the core current (Icore) but the supply current (Ivdd). Because the supply current (Ivdd) is relatively more consistent than the core current (Icore), the operation of the core circuit 25 will not be revealed by measuring the supply current (Ivdd).

Figure 7:
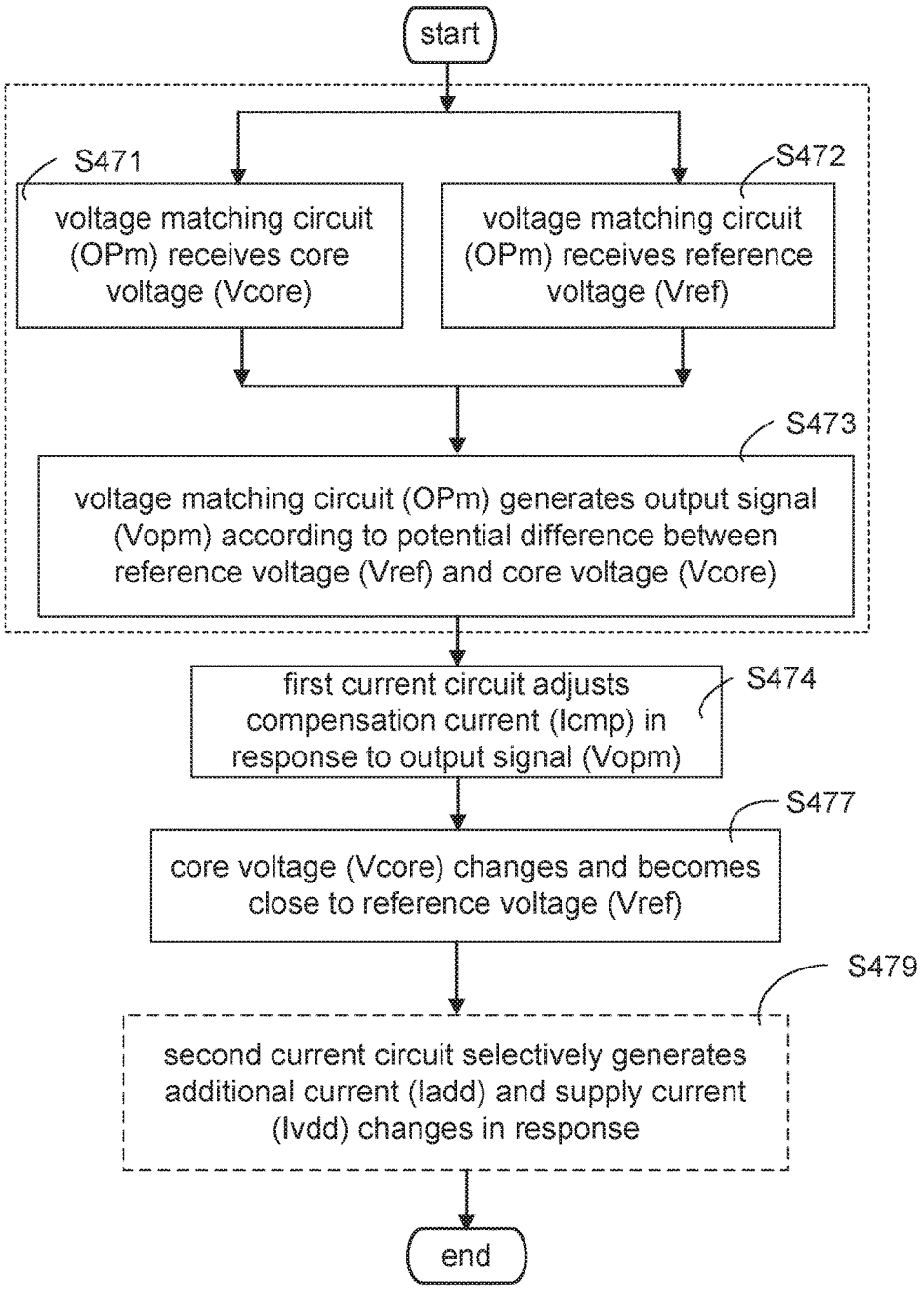
FIG. 7 is a flow chart illustrating operation of the current compensation circuit.

FIG. 7 is a flow chart illustrating operation of the current compensation circuit. Firstly, the voltage matching circuit 50*a* respectively receives the core voltage (Vcore) (step S471) and the reference voltage (Vref) (step S472). Then, the voltage matching circuit 50*a* generates the output signal (Vopm) according to potential difference between the reference voltage (Vref) and the core voltage (Vcore) (step S473). The dotted rectangle surrounded steps S471, S472 and S473 is corresponding to operations of the voltage matching circuit 50*a*.

The first current circuit 50*b* generates and adjusts the compensation current (Icmp) according to the output signal (Vopm) of the voltage matching circuit 50*a* (step S474). Change of the compensation current (Icmp) results in change of the core voltage (Vcore). Consequentially, the core voltage (Vcore) changes and becomes closer to the reference voltage (Vref) (step S477). In a case that the second switch (sw2) is turned on, the second current circuit 50*c* generates the additional current (Iadd) (step S479). The operation flow in FIG. 7 is repeatedly executed until the core voltage (Vcore) is equivalent to the reference voltage (Vref).

Figure 8:
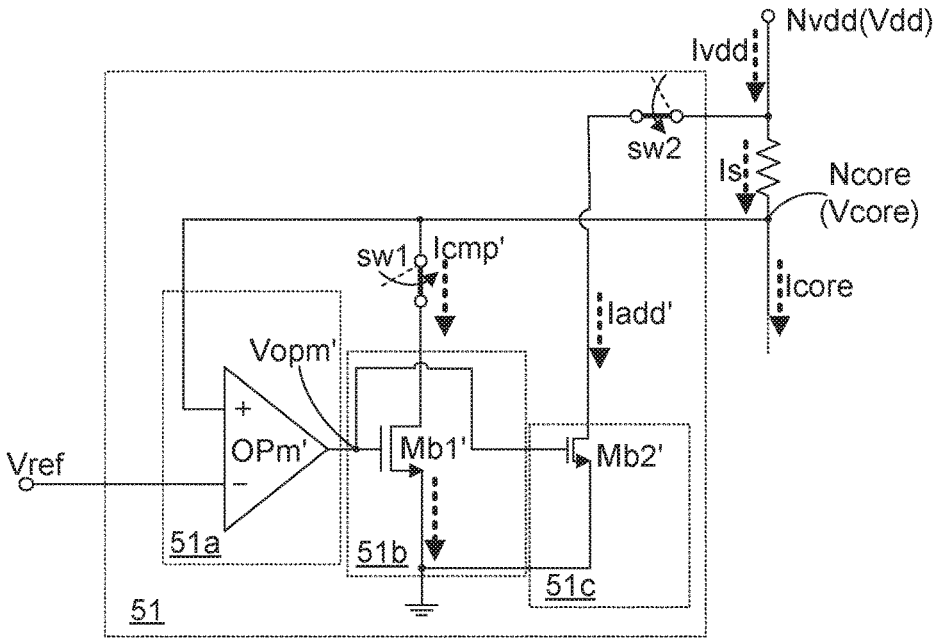
FIG. 8 is a schematic diagram illustrating an embodiment of the current compensation circuit.

FIG. 8 is a schematic diagram illustrating an embodiment of the current compensation circuit. The current compensation circuit 51 includes a voltage matching circuit 51*a*, a first current circuit 51*b*, and a second current circuit 51*c*.

The voltage matching circuit 51*a* includes a matching operational amplifier (OPm'). The matching operational amplifier (OPm') has an inverting input terminal (−), a non-inverting input terminal (+) and an output terminal. The inverting input terminal (−) of the matching operational amplifier (OPm') receives the reference voltage (Vref) from the reference voltage regulator 30, and the non-inverting input terminal (+) of the matching operational amplifier (OPm') is electrically connected to the core node (Ncore) and the first current circuit 51*b*. The output terminal of the matching operational amplifier (OPm') is electrically connected to the first current circuit 51*b* and the second current circuit 51*c*.

The first current circuit 51*b* includes a compensation transistor (Mb1') (for example, a third NMOS transistor) and the second current circuit 51*c* includes an additional transistor (Mb2') (for example, a fourth NMOS transistor). Generally speaking, size of the additional transistor (Mb2') is designed to be smaller than size of the compensation transistor (Mb1'). Based on the size relationship of the transistors, the additional current (Iadd') flowing through the additional transistor (Mb2') is less than the compensation current (Icmp') flowing through the compensation transistor (Mb1'). A control terminal of the compensation transistor (Mb1') and the additional transistor (Mb2') jointly electrically connected to the output terminal of the matching operational amplifier (OPm'). Therefore, conduction of the compensation transistor (Mb1') and the additional transistor (Mb2') are determined by the output signal (Vopm') of the matching operational amplifier (OPm').

When the output signal (Vopm') of the matching operational amplifier (OPm') is greater than threshold voltage of the compensation transistor (Mb1') and the additional transistor (Mb2'), the compensation transistor (Mb1') and the additional transistor (Mb2') will be conducted and the compensation current (Icmp') and the additional current (Iadd) are generated in response. The compensation current (Icmp') flows from the core node (Ncore) to the ground node (Gnd) through the compensation transistor (Mb1'), and the additional current (Iadd') flows from the supply voltage node (Nvdd) to the ground node (Gnd) through the additional transistor (Mb2').

If size of the additional transistor (Mb2') is smaller than size of the compensation transistor (Mb1'), conduction speed of the additional transistor (Mb2) can be faster than that of the compensation transistor (Mb1). In other words, generation of the additional current (Iadd') is faster than generation of the compensation current (Icmp').

Figure 9:
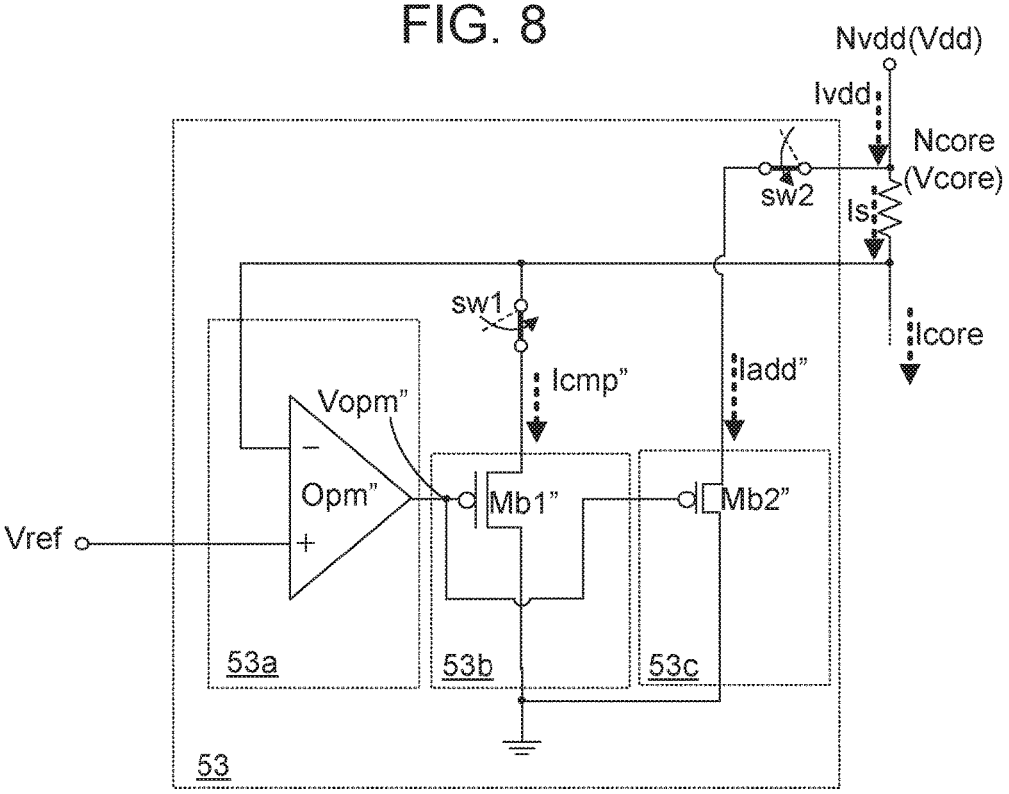
FIG. 9 is a schematic diagram illustrating another embodiment of the current compensation circuit.

FIG. 9 is a schematic diagram illustrating another embodiment of the current compensation circuit. The current compensation circuit 53 includes a voltage matching circuit 53*a*, a first current circuit 53*b*, and a second current circuit 53*c*.

The voltage matching circuit 53*a* includes a matching operational amplifier (OPm"). The matching operational amplifier (OPm") has a non-inverting input terminal (+) for receiving the reference voltage (Vref) from the reference voltage regulator 30, an inverting input terminal (−) being electrically connected to the core node (Ncore) and the first current circuit 53*b*, and an output terminal being electrically connected to the first current circuit 53*b* and the second current circuit 53*c*.

The first current circuit 53*b* includes a compensation transistor (Mb1") (for example, a third PMOS transistor) and the second current circuit 53*c* includes an additional transistor (Mb2") (for example, a fourth PMOS transistor). Size of the additional transistor (Mb2") is generally smaller than size of the compensation transistor (Mb1"). Based on the size relationship of the transistors, the additional current (Iadd") flowing through the additional transistor (Mb2") is less than the compensation current (Icmp") flowing through the compensation transistor (Mb1"). A control terminal of the compensation transistor (Mb1") and the additional transistor (Mb2") jointly electrically connected to the output terminal of the matching operational amplifier (OPm").

When a voltage difference between the core voltage (Vcore) and the reference voltage (Vref) exists so that the output signal (Vopm") of the matching operational amplifier (OPm") is greater than threshold voltage of the compensation transistor (Mb1") and the additional transistor (Mb2"), the compensation transistor (Mb1") and the additional transistor (Mb2") will be conducted an the compensation current (Icmp') and the additional current (Iadd") are generated in response. The compensation current (Icmp") flows from the core node (Ncore) to the ground node (Gnd) through the compensation transistor (Mb1"), and the additional current (Iadd") flows from the supply voltage node (Vdd) to the ground node (Gnd) through the additional transistor (Mb2"). If size of the additional transistor (Mb2") is smaller than size of the compensation transistor (Mb1"), conduction speed of the additional transistor (Mb2") will be faster than that of the compensation transistor (Mb1"). In other words, generation of the additional current (Iadd") is faster than generation of the compensation current (Icmp").

The disclosure presented a current flattening circuit including a current sensing circuit, a current compensation circuit and a reference voltage regulator. The reference voltage regulator provides the reference voltage (Vref) to the current compensation circuit, and the current compensation circuit generates a compensation current (Icmp) in response to change of the core current (Icore) flowing to the core circuit. The current compensation current (Icmp) can in general maintain equivalence between the reference voltage (Vref) and the core voltage (Vcore). In consequence, the sensing current (Is) flowing through the current sensing circuit can be maintained consistent. As illustrated above, with the inclusion of the additional current (Iadd), the supply current (Ivdd) may become more consistent.

While the disclosure has been described by way of example and in terms of the preferred embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A current flattening circuit, electrically connected to a core node, comprising:

a reference voltage regulator, configured for generating a reference voltage, wherein the reference voltage is constant;

a current compensation circuit, electrically connected to the core node and the reference voltage regulator, configured for generating a compensation current in response a potential difference between the reference voltage and a core voltage corresponding to the core node; and a current sensing circuit, configured for conducting a sensing current flowing through a supply voltage node and the core node, wherein a voltage of the supply voltage node is greater than the core voltage, the sensing current is equivalent to a summation of a core current and the compensation current, and the current compensation circuit generates the compensation current to keep the sensing current constant.

2. The current flattening circuit according to claim 1, wherein the reference voltage regulator comprises:

a voltage providing circuit, configured for receiving a constant voltage;

a voltage to current circuit, electrically connected to the voltage providing circuit, configured for generating a source current according to the constant voltage;

a current to voltage circuit, configured for receiving a supply voltage and generating the reference voltage according to the supply voltage and a reference current, wherein a current value of the reference current is proportional to a current value of the source current; and a current conduction circuit, electrically connected to the voltage providing circuit, the voltage to current circuit and the current to voltage circuit, configured for providing the reference current according to the source current.

3. The current flattening circuit according to claim 2, wherein the voltage providing circuit comprises a source operational amplifier, the voltage to current circuit comprises a first resistor, and the current to voltage circuit comprises a second resistor.

4. The current flattening circuit according to claim 3, wherein an inverting input terminal of the source operational amplifier configured for receiving the constant voltage;

a non-inverting input terminal of the source operational amplifier is electrically connected to the voltage to current circuit; and an output terminal of the source operational amplifier is electrically connected to the current conduction circuit.

5. The current flattening circuit according to claim 1, wherein the current compensation circuit comprises:

a voltage matching circuit, configured for receiving the reference voltage and the core voltage, wherein an output signal of the voltage matching circuit changes in response to a potential difference between the reference voltage and the core voltage; and a first current circuit, electrically connected to the core node and the voltage matching circuit and configured for generating the compensation current.

6. The current flattening circuit according to claim 5, wherein the current compensation circuit further comprises:

a second current circuit, electrically connected to the voltage matching circuit, configured for generating an additional current conducting from a supply voltage node according to the output signal of the voltage matching circuit, wherein the additional current is proportional to the compensation current.

7. The current flattening circuit according to claim 6, wherein the second current circuit is configured for conducting or cutting off the additional current according to a random sequence control signal.

8. The current flattening circuit according to claim 5, wherein the voltage matching circuit comprises a matching operational amplifier, wherein a first input terminal of the matching operational amplifier configure for receiving the reference voltage from the reference voltage regulator;

a second input terminal of the matching operational amplifier is electrically connected to the core node and the first current circuit, and an output terminal of the matching operational amplifier is electrically connected to the first current circuit.

9. A current compensation circuit, electrically connected to a core node, comprising:

a voltage matching circuit, configured for receiving a reference voltage, which is constant and a core voltage corresponding to the core node, wherein an output signal of the voltage matching circuit changes in response to a potential difference between the reference voltage and the core voltage;

a sensing circuit, configured for conducting a sensing current flowing through the supply voltage node and the core node, wherein a voltage of the supply voltage node is greater than the core voltage, and the sensing current is eauivalent to a summation of a core current and a compensation current; and a first current circuit, electrically connected to the core node, configured for receiving the output signal of the voltage matching circuit, and generating the compensation current to keep the sensing current constant.

10. The current compensation circuit according to claim 9, wherein the compensation current becomes stable when the core voltage and the reference voltage are equivalent.

11. The current compensation circuit according to claim 9, further comprises:

a second current circuit, electrically connected to the voltage matching circuit, configured for generating an additional current according to the output signal of the voltage matching circuit, wherein the additional current is proportional to the compensation current.

12. The current compensation circuit according to claim 11, wherein the first current circuit comprises a compensation transistor configured for generating the compensating current, and the second current circuit comprises an additional transistor configured for generating the additional current, wherein a control terminal of the compensation transistor and a control terminal of the additional transistor are configured for jointly receiving the output signal of the voltage matching circuit.

13. The current compensation circuit according to claim 9, wherein the voltage matching circuit comprises a matching operational amplifier, wherein a first input terminal of the matching operational amplifier configured for receiving the reference voltage from a reference voltage regulator;

a second input terminal of the matching operational amplifier is electrically connected to the core node and the first current circuit; and an output terminal of the matching operational amplifier is electrically connected to the first current circuit.

14. A control method, applied to a current flattening circuit, comprises steps of:

generating a reference voltage which is constant;

generating a compensation current in response to a potential difference between the reference voltage and a core voltage corresponding to a core node; and conducting a sensing current flowing through a supply voltage node and the core node, wherein a voltage of the supply voltage node is greater than the core voltage, the sensing current is equivalent to a summation of a core current and the compensation current, and the compensation current is generated to keep the sensing current constant.

15. The control method according to claim 14, for compensating the core current, wherein the step of generating the compensation current according to the potential difference between the reference voltage and the core voltage further comprises steps of:

generating an output signal in response to the potential difference between the reference voltage and the core voltage; and generating the compensation current and an additional current according to the output signal, wherein the additional current is proportional to the compensation current, and the additional current together with the core current and the compensation current form the supply current.

16. The control method according to claim 15, wherein the additional current is conducted or cut off randomly.

17. The control method according to claim 15, wherein the step of generating the reference voltage comprises steps of:

receiving a constant voltage;

generating a source current according to the constant voltage;

generating a reference current according to the source current, wherein a current value of the reference current is proportional to a current value of the source current; and generating the reference voltage according to the reference current.

* * * * *